US010720738B1

(12) United States Patent
Wu

(10) Patent No.: US 10,720,738 B1
(45) **Date of Patent: *Jul. 21, 2020**

(54) HIGH SPEED CONNECTOR AND TRANSMISSION MODULE THEREOF

(71) Applicant: Greenconn Corp., New Taipei (TW)

(72) Inventor: Kun-Shen Wu, New Taipei (TW)

(73) Assignee: Greenconn Corp., New Taipei (TW)

( * ) Notice: Subject to any disclaimer, the term of this patent is extended or adjusted under 35 U.S.C. 154(b) by 0 days.

This patent is subject to a terminal disclaimer.

(21) Appl. No.: 16/391,226

(22) Filed: Apr. 22, 2019

(51) Int. Cl.
*H01R 24/60* (2011.01)

(52) U.S. Cl.
CPC ..... *H01R 24/60* (2013.01)

(58) Field of Classification Search
CPC . H01R 13/6585; H01R 24/60; H01R 2107/00
USPC ..... 439/660, 79, 607.09
See application file for complete search history.

(56) References Cited

U.S. PATENT DOCUMENTS 8,523,583 B2 * 9/2013 Ito ..... H01R 12/721 439/108
8,702,452 B2 * 4/2014 Tai ..... H01R 13/6474 439/108
9,039,457 B2 * 5/2015 Zhang ..... H01R 13/6275 439/357
9,520,678 B2 * 12/2016 Su ..... H01R 13/6477
9,531,130 B1 * 12/2016 Phillips ..... H01R 13/6471
10,128,620 B1 * 11/2018 Wu ..... H01R 13/6585
2012/0252232 A1 * 10/2012 Buck ..... H01R 12/585 439/55
2013/0065454 A1 * 3/2013 Milbrand, Jr. ..... H01R 12/724 439/676
2015/0155665 A1 * 6/2015 Su ..... H01R 13/6477 439/676
2015/0207247 A1 * 7/2015 Regnier ..... H01R 9/2408 439/78
2016/0079709 A1 * 3/2016 Su ..... H01R 13/6477 439/660
2018/0006233 A1 * 1/2018 Cha ..... H01L 51/005
2018/0131145 A1 * 5/2018 Zhao ..... H01R 13/04

FOREIGN PATENT DOCUMENTS

CN 108649366 A 10/2018
TW M532100 U 11/2016

* cited by examiner

*Primary Examiner* — Gary F Paumen
(74) *Attorney, Agent, or Firm* — Li & Cai Intellectual Property Office

(57) ABSTRACT

A transmission module of a high speed connector includes an insulating core and two rows of conductive terminals fixed to the insulating core and parallel to a width direction. Each of the conductive terminals includes an embedded segment fixed and embedded in the insulating core, a contacting segment, and a fixing segment, the latter two of which respectively extend from two opposite ends of the embedded segment. Each of the embedded segments has a minimum width within a range of 0.26-0.3 mm. Each of the touching segments includes a front extending portion having a maximum width within a range of 0.34-0.38 mm and a touching portion having a maximum width within a range of 0.23-0.27 mm. The embedded segments and the touching segments of one of the two rows of the conductive terminals are mirror-symmetrical to and face those of the other row of the conductive terminals.

10 Claims, 12 Drawing Sheets

HIGH SPEED CONNECTOR AND TRANSMISSION MODULE THEREOF

FIELD OF THE DISCLOSURE

The present disclosure relates to a connector, and more particularly to a high speed connector and a transmission module thereof each provided for transmitting a high frequency signal having a frequency band within a range of 12-17 GHz by a speed within a range of 20-25 Gbps.

BACKGROUND OF THE DISCLOSURE

A conventional high speed connector is provided with a grounding bar that is structurally and electrically connected with a plurality of grounding terminals thereof, thereby improving performance of the conventional high speed connector. Accordingly, the conventional high speed connector can pass various tests by adding the grounding bar.

However, since the conventional high speed connector mainly relies on an added component (i.e., the grounding bar) to improve the performance and to pass the various tests, structures of other components of the conventional high speed connector need to be changed to cooperate with the grounding bar, causing the overall configuration of the conventional high speed connector to be more complicated. In other words, improvements on a conductive module (e.g., conductive terminals) of a high speed connector have been widely neglected during development in the field of connectors.

SUMMARY OF THE DISCLOSURE

In response to the above-referenced technical inadequacies, the present disclosure provides a high speed connector and a transmission module thereof to solve the drawbacks associated with conventional high speed connectors.

In one aspect, the present disclosure provides a high speed connector for transmitting a high frequency signal having a frequency band within a range of 12-17 GHz by a speed within a range of 20-25 Gbps. The high speed connector includes a housing, an insulating core, a plurality of first conductive terminals, a plurality of second conductive terminals, and a metallic shell. The housing has an insertion opening that provides for an insertion of a mating connector along an inserting direction. The insulating core is inserted into the housing. The first conductive terminals are fixed to the insulating core and are arranged along a width direction perpendicular to the inserting direction. Each of the first conductive terminals includes a first embedded segment, a first contacting segment, and a first fixing segment. The first embedded segment is fixed and embedded in the insulating core, and the first embedded segment has a minimum width that is within a range of 0.26-0.3 mm. The first contacting segment extends from the first embedded segment toward the insertion opening to sequentially include a first front extending portion and a first contacting portion. The first front extending portion has a maximum width that is within a range of 0.34-0.38 mm, and the first contacting portion has a maximum width that is within a range of 0.23-0.27 mm. The first fixing segment extends from the first embedded segment along a direction away from the insertion opening to sequentially include a first rear extending portion and a first fixing portion. The first rear extending portion has a maximum width that is within a range of 0.34-0.38 mm. The second conductive terminals are fixed to the insulating core and are arranged along the width direction. The second conductive terminals respectively correspond in position to the first conductive terminals, and each of the second conductive terminals includes a second embedded segment, a second contacting segment, and a second fixing segment. The second embedded segment is fixed and embedded in the insulating core, and the second embedded segment has a minimum width that is within a range of 0.26-0.3 mm. The second contacting segment extends from the second embedded segment toward the insertion opening to sequentially include a second front extending portion and a second contacting portion. The second front extending portion has a maximum width that is within a range of 0.34-0.38 mm, and the second contacting portion has a maximum width that is within a range of 0.23-0.27 mm. The second fixing segment extends from the second embedded segment along a direction away from the insertion opening to sequentially include a second rear extending portion and a second fixing portion. The second rear extending portion has a maximum width that is within a range of 0.34-0.38 mm. The metallic shell is engaged with an outer surface of the housing. The first embedded segments and the first contacting segments of the first conductive terminals and the second embedded segments and the second contacting segments of the second conductive terminals are arranged in a space surroundingly defined by the metallic shell. The first embedded segments and the first contacting segments of the first conductive terminals respectively face and are mirror-symmetrical to the second embedded segments and the second contacting segments of the second conductive terminals along a height direction that is perpendicular to the inserting direction and the width direction.

In one aspect, the present disclosure provides a transmission module of a high speed connector for transmitting a high frequency signal having a frequency band within a range of 12-17 GHz by a speed within a range of 20-25 Gbps. The transmission module includes an insulating core, a plurality of first conductive terminals, and a plurality of second conductive terminals. The first conductive terminals are fixed to the insulating core and are arranged along a width direction. Each of the first conductive terminals includes a first embedded segment, a first contacting segment, and a first fixing segment. The first embedded segment is fixed and embedded in the insulating core, and the first embedded segment has a minimum width that is within a range of 0.26-0.3 mm. The first contacting segment extends from one end of the first embedded segment and sequentially includes a first front extending portion and a first contacting portion. The first front extending portion has a maximum width that is within a range of 0.34-0.38 mm, and the first contacting portion has a maximum width that is within a range of 0.23-0.27 mm. The first fixing segment extends from another end of the first embedded segment and sequentially includes a first rear extending portion and a first fixing portion. The first rear extending portion has a maximum width that is within a range of 0.34-0.38 mm. The second conductive terminals are fixed to the insulating core and are arranged along the width direction. The second conductive terminals respectively correspond in position to the first conductive terminals, and each of the second conductive terminals includes a second embedded segment, a second contacting segment, and a second fixing segment. The second embedded segment is fixed and embedded in the insulating core, and the second embedded segment has a minimum width that is within a range of 0.26-0.3 mm. The second contacting segment extends from one end of the second embedded segment and sequentially includes a second front extending portion and a second contacting portion.

The second front extending portion has a maximum width that is within a range of 0.34-0.38 mm, and the second contacting portion has a maximum width that is within a range of 0.23-0.27 mm. The second fixing segment extends from another end of the second embedded segment and sequentially includes a second rear extending portion and a second fixing portion. The second rear extending portion has a maximum width that is within a range of 0.34-0.38 mm. The first embedded segments and the first contacting segments of the first conductive terminals respectively face and are mirror-symmetrical to the second embedded segments and the second contacting segments of the second conductive terminals along a height direction that is perpendicular to the width direction.

Therefore, the high speed connector and the transmission module of the present disclosure can have better transmission efficiency of high frequency signals (e.g., an insertion loss and a return loss) by designing the first conductive terminals and the second conductive terminals with certain dimensions and by cooperating the first conductive terminals and the second conductive terminals with the insulating core. Accordingly, the high speed connector and the transmission module of the present disclosure can be provided without any grounding bar.

These and other aspects of the present disclosure will become apparent from the following description of the embodiment taken in conjunction with the following drawings and their captions, although variations and modifications therein may be affected without departing from the spirit and scope of the novel concepts of the disclosure.

BRIEF DESCRIPTION OF THE DRAWINGS

The present disclosure will become more fully understood from the following detailed description and accompanying drawings.

DETAILED DESCRIPTION OF THE EXEMPLARY EMBODIMENTS

Figure 1:
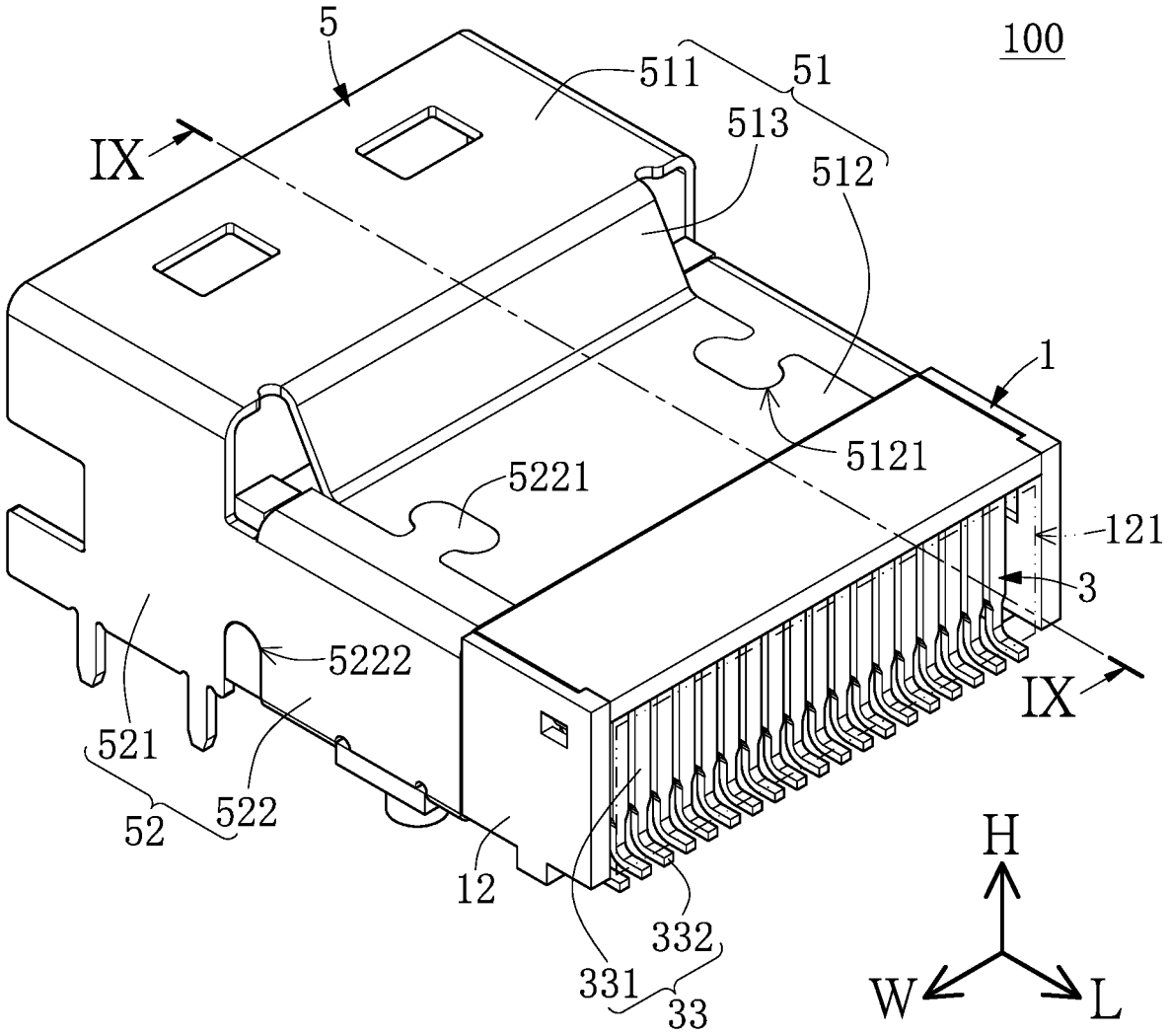
FIG. 1 is a perspective view of a high speed connector according to a first embodiment of the present disclosure.

The present disclosure is more particularly described in the following examples that are intended as illustrative only since numerous modifications and variations therein will be apparent to those skilled in the art. Like numbers in the drawings indicate like components throughout the views. As used in the description herein and throughout the claims that follow, unless the context clearly dictates otherwise, the meaning of "a", "an", and "the" includes plural reference, and the meaning of "in" includes "in" and "on". Titles or subtitles can be used herein for the convenience of a reader, which shall have no influence on the scope of the present disclosure.

The terms used herein generally have their ordinary meanings in the art. In the case of conflict, the present document, including any definitions given herein, will prevail. The same thing can be expressed in more than one way. Alternative language and synonyms can be used for any term(s) discussed herein, and no special significance is to be placed upon whether a term is elaborated or discussed herein. A recital of one or more synonyms does not exclude the use of other synonyms. The use of examples anywhere in this specification including examples of any terms is illustrative only, and in no way limits the scope and meaning of the present disclosure or of any exemplified term. Likewise, the present disclosure is not limited to various embodiments given herein. Numbering terms such as "first", "second" or "third" can be used to describe various components, signals or the like, which are for distinguishing one component/signal from another one only, and are not intended to, nor should be construed to impose any substantive limitations on the components, signals or the like.

First Embodiment

Figure 2:
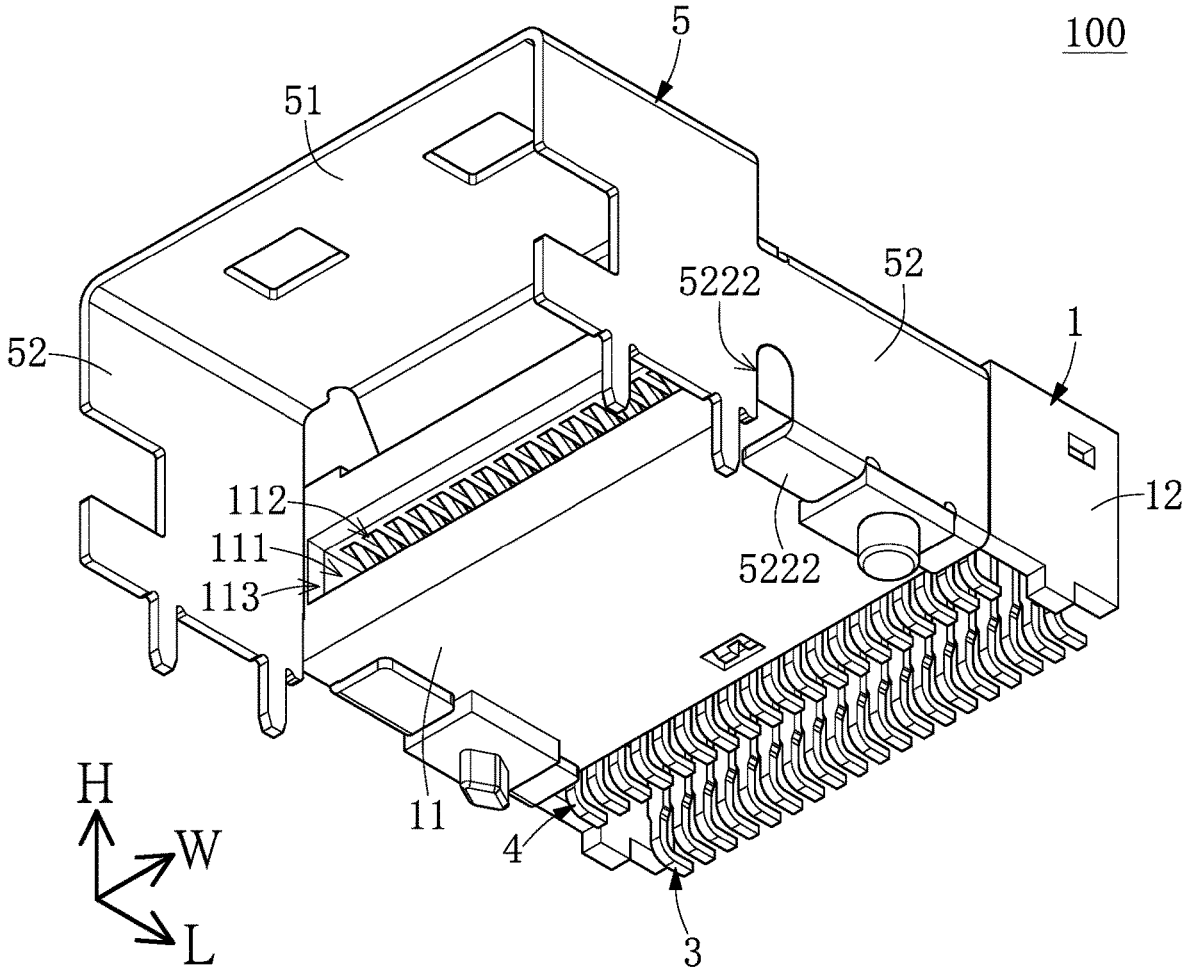
FIG. 2 is a perspective view of FIG. 1 from another angle.

Referring to FIG. 1 to FIG. 9, a first embodiment of the present disclosure provides a high speed connector 100. As shown in FIG. 1 and FIG. 2, the high speed connector 100 in the present embodiment is used for transmitting a high frequency signal having a frequency band within a range of 12-17 GHz by a speed within a range of 20-25 Gbps, and the high speed connector 100 is preferably a right angle connector, but the present disclosure is not limited thereto. The high speed connector 100 includes a housing 1, an insulating core 2 inserted into the housing 1, a plurality of first conductive terminals 3 fixed to the insulating core 2, a plurality of second conductive terminals 4 fixed to the insulating core 2, and a metallic shell 5 engaged with an outer surface of the housing 1. The following description discloses the structure and connection relationship of each component of the high speed connector 100.

As shown in FIG. 3 to FIG. 6, in order to clearly describe the present embodiment, the housing 1 defines a width direction W, a longitudinal direction L, and a height direction H, which are perpendicular to each other. The housing 1 includes a main portion 11 and two positioning sheets 12 respectively extending from two opposite sides of a rear end of the main portion 11. The main portion 11 has an inserting channel 111 and a plurality of terminal slots 112 arranged in two rows. The two rows of the terminal slots 112 are respectively arranged above and under the inserting channel 111, and are in spatial communication with the inserting channel 111. Each row of the terminal slots 112 is arranged along the width direction W of the housing 1.

The main portion 11 has an insertion opening 113 that is formed on a front end of the main portion 11 for providing an insertion of a mating connector (not shown) along an inserting direction L (i.e., the longitudinal direction L). The main portion 11 has a receiving slot 114 formed on the rear end thereof. The insertion opening 113 and the receiving slot 114 are respectively arranged at a front side and a rear side of the inserting channel 111, and are in in spatial communication with the inserting channel 111. Moreover, the housing 1 has a hole 121 arranged away from the insertion opening 113, e.g., at a position between the two positioning sheets 12.

Figure 5:
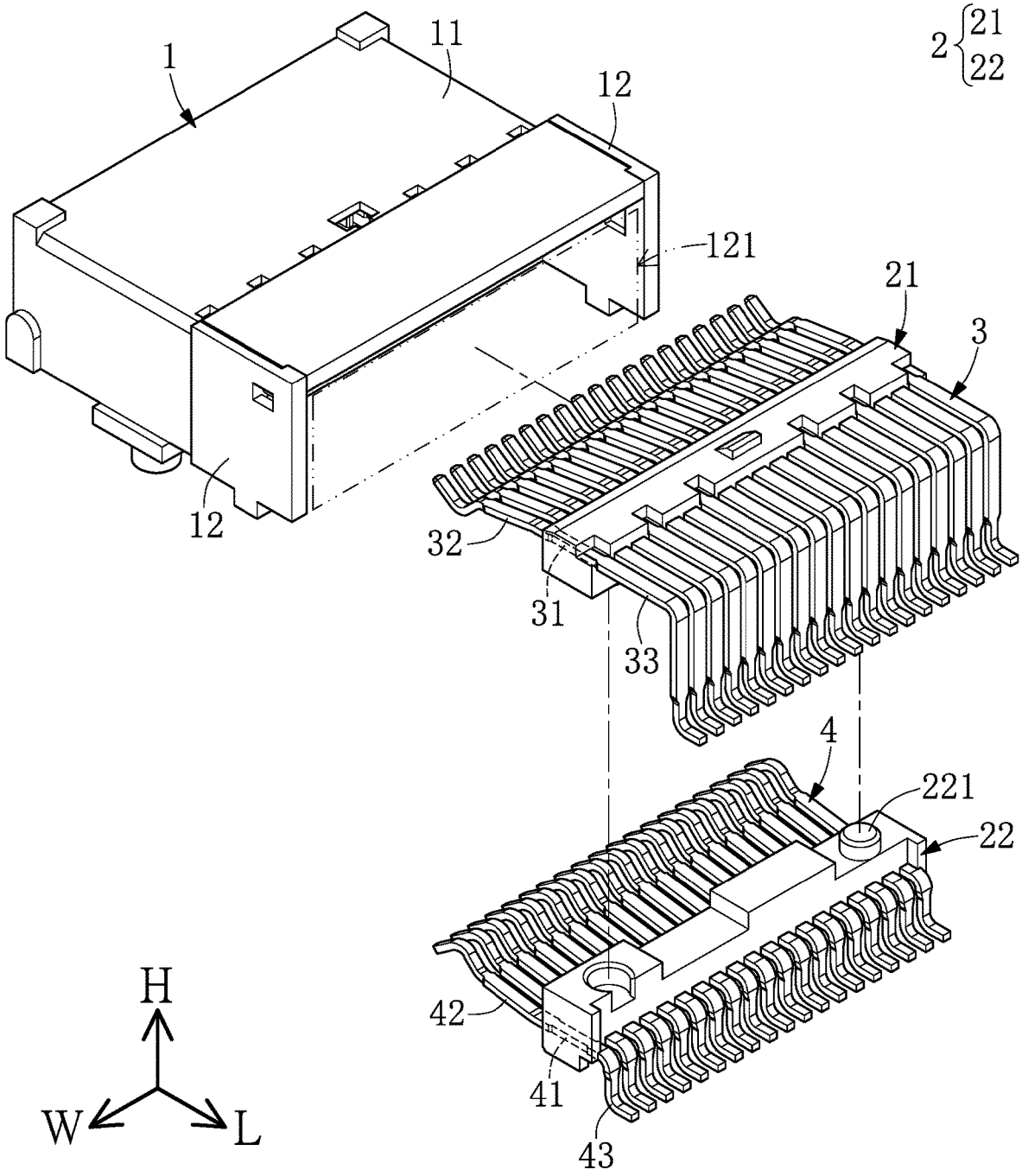
FIG. 5 is an exploded view of FIG. 3 with a metallic shell omitted.
Figure 6:
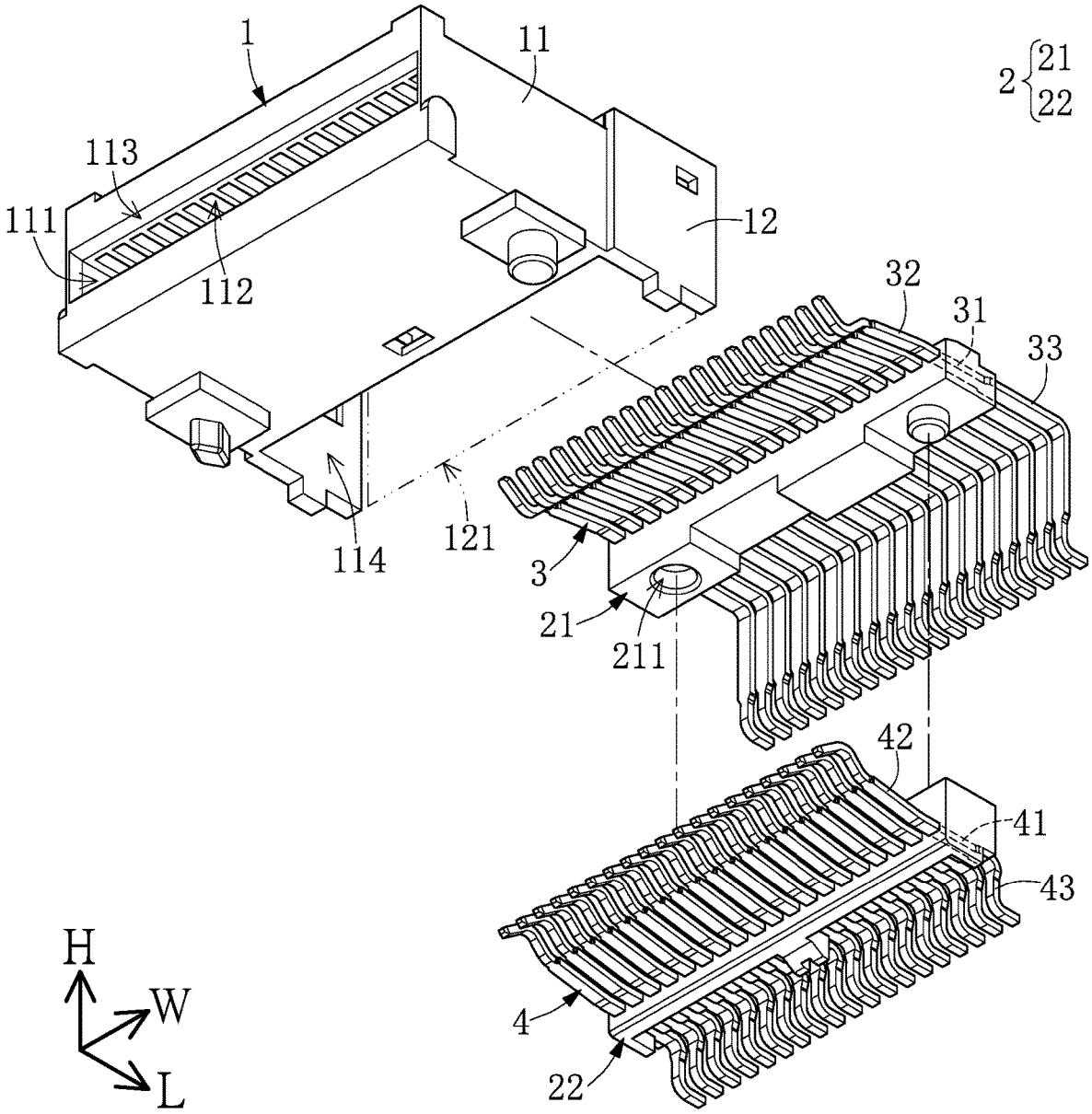
FIG. 6 is an exploded view of FIG. 4 with the metallic shell omitted.

As shown in FIG. 5 and FIG. 6, the insulating core 2 is inserted into the housing 1, and the insulating core 2 in the present embodiment is inserted into the receiving slot 114 of the housing 1 to serve as a boundary of the inserting channel 111, but the present disclosure is not limited thereto. The insulating core 2 includes a first plastic core 21 and a second plastic core 22. The first plastic core 21 has a concave-convex structure 211, the second plastic core 22 has a mating structure 221, and the first plastic core 21 is fixed on the second plastic core 22 by detachably inserting the concave-convex structure 211 onto or into the mating structure 221.

In addition, the insulating core 2 in the present embodiment adapts the first plastic core 21 and the second plastic core 22 inserted into the first plastic core 21, but the present disclosure is not limited thereto. That is to say, the insulating core 2 can be adjusted according to practical needs. In other embodiments of the present disclosure, the insulating core 2 can be integrally formed as a one-piece structure.

As shown in FIG. 5 and FIG. 6, the first conductive terminals 3 are arranged in one row parallel to the width direction W, and are fixed on the first plastic core 21. Each of the first conductive terminals 3 is substantially arranged in the housing 1. Each of the first conductive terminals 3 has a first embedded segment 31 fixed and embedded in the first plastic core 21 of the insulating core 2, a first contacting segment 32 extending from one end of the first embedded segment 31 toward the insertion opening 113, and a first fixing segment 33 extending from another end of the first embedded segment 31 in a direction away from the insertion opening 113. That is to say, the first contacting segments 32 are arranged in the upper row of the terminal slots 112 of the main portion 11, and each of the first contacting segments 32 is partially located in the inserting channel 111. The first fixing segments 33 are arranged between the two positioning sheets 12, and are exposed from the hole 121.

As the first conductive terminals 3 in the present embodiment are substantially of the same structure, the following description discloses the structure of just one of the first conductive terminals 3 for the sake of brevity, but the present disclosure is not limited thereto. For example, in other embodiments of the present disclosure, the high speed connector 100 can also adopt first conductive terminals 3 that have slightly different structures from each other or from the structures disclosed in the following description.

Figure 7:
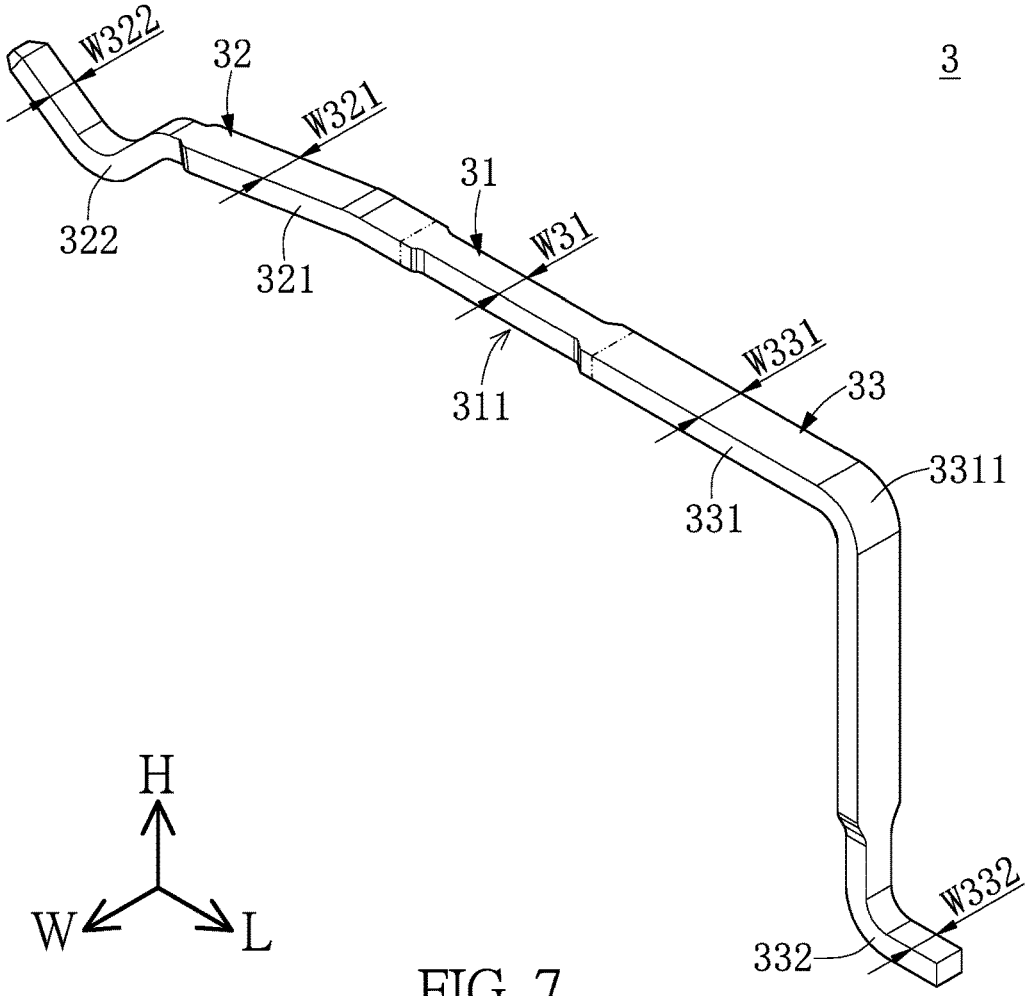
FIG. 7 is a perspective view of a first conductive terminal according to the first embodiment of the present disclosure.

Specifically, as shown in FIG. 5 to FIG. 7, the first embedded segment 31 has a minimum width W31 that is within a range of 0.26-0.3 mm (e.g., 0.28 mm), and the first embedded segment 31 has a length within a range of 1.4-1.6 mm (e.g., 1.5 mm) In other words, the first embedded segment 31 has two concavities 311 respectively recessed in two opposite long edges thereof, and the minimum width W31 of each of the first embedded segment 31 is defined by a distance between bottoms of the two concavities 311.

The first contacting segment 32 sequentially includes a first front extending portion 321 and a first contacting portion 322 extending from the first embedded segment 31. The first front extending portion 321 has a maximum width W321 that is within a range of 0.34-0.38 mm, the first extending portion 321 has a length within a range of 2.3-2.5 mm (e.g., 0.24 mm), and the first contacting portion 322 has a maximum width W322 that is within a range of 0.23-0.27 mm (e.g., 0.25 mm).

Moreover, the first fixing segment 33 sequentially includes a first rear extending portion 331 and a first fixing portion 332 extending from the first embedded segment 31, and the first rear extending portions 331 in the present embodiment is formed without any concavities. That is to say, two opposite long edges of the first rear extending portions 331 form straight lines parallel to each other. The first rear extending portion 331 has a maximum width W331 that is within a range of 0.34-0.38 mm (e.g., 0.36 mm), the first rear extending portion 331 has a length (i.e., a sum of a length of a part of the first rear extending portion 331 in the longitudinal direction L and a length of another part of the first rear extending portion 331 in the height direction H) within a range of 5.7-5.9 mm (e.g., 5.84 mm), and the first fixing portion 332 has a minimum width W332 within a range of 0.23-0.27 mm (e.g., 0.25 mm).

It should be noted that the structure of the first conductive terminal 3 disclosed in the present embodiment can only be adapted to the high speed connector 100 structure with the first fixing segment 33 being exposed through the hole 121. In other words, a connector having a cover to shield a hole thereof cannot be adapted with the first conductive terminal 3 of the present embodiment.

Figure 8:
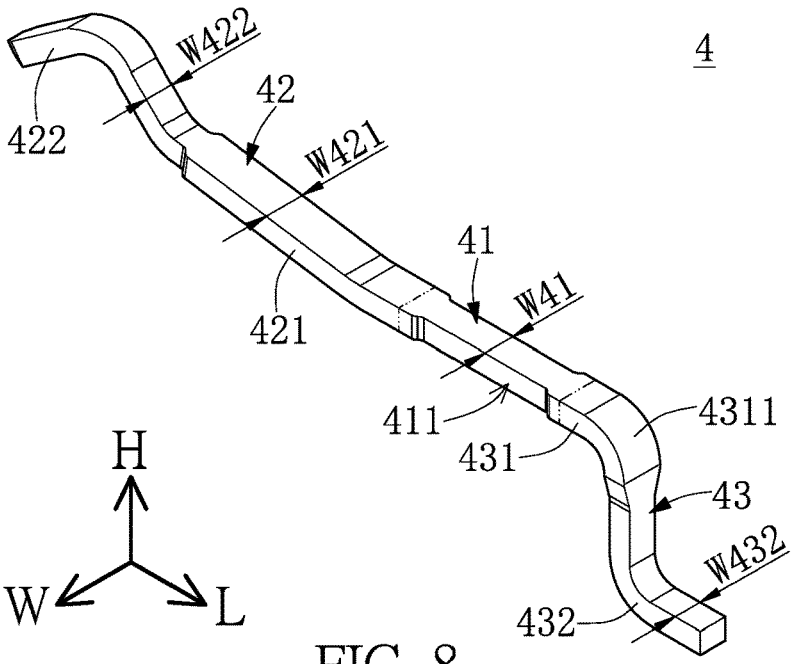
FIG. 8 is a perspective view of a second conductive terminal according to the first embodiment of the present disclosure.

As shown in FIG. 5, FIG. 6, and FIG. 8, the second conductive terminals 4 are arranged in one row parallel to the width direction W, and are fixed on the second plastic core 22. Each of the second conductive terminals 4 is substantially arranged in the housing 1, and has a length less than or equal to that of the first conductive terminal 3. Each of the second conductive terminals 4 has a second embedded segment 41 fixed and embedded in the second plastic core 22 of the insulating core 2, a second contacting segment 42 extending from one end of the second embedded segment 41 toward the insertion opening 113, and a second fixing segment 43 extending from another end of the second embedded segment 41 in a direction away from the insertion opening 113. That is to say, the second contacting segments 42 are arranged in the lower row of the terminal slots 112 of the main portion 11, and each of the second contacting segments 42 is partially located in the inserting channel 111. The second fixing segments 43 are arranged between the two positioning sheets 12.

As the second conductive terminals 4 in the present embodiment are of the same structure, the following description discloses the structure of just one of the second conductive terminals 4 for the sake of brevity, but the present disclosure is not limited thereto. For example, in other embodiments of the present disclosure, the second conductive terminals 4 can have different structures from each other or from the structures disclosed in the following description.

Specifically, as shown in FIG. 5 to FIG. 7, the second embedded segment 41 has a minimum width W41 that is within a range of 0.26-0.3 mm (e.g., 0.28 mm), and the second embedded segment 41 has a length within a range of 1.4-1.6 mm (e.g., 1.5 mm) In other words, the second embedded segment 41 has two concavities 411 respectively recessed in two opposite long edges thereof, and the minimum width W41 of the second embedded segment 41 is defined by a distance between bottoms of the two concavities 411.

The second contacting segment 42 sequentially extends from the second embedded segment 41 to form a second front extending portion 421 and a second contacting portion 422. The second front extending portion 421 has a maximum width W421 that is within a range of 0.34-0.38 mm, the second extending portion 421 has a length within a range of 2.3-2.5 mm (e.g., 0.24 mm), and the second contacting portion 422 has a maximum width W422 that is within a range of 0.23-0.27 mm (e.g., 0.25 mm).

Moreover, the second fixing segment 43 sequentially extends from the second embedded segment 41 to form a second rear extending portion 431 and a second fixing portion 432, and the second rear extending portions 431 in the present embodiment is formed without any concavities. The second rear extending portion 431 has a maximum width W431 that is within a range of 0.34-0.38 mm (e.g., 0.36 mm), the second rear extending portion 431 has a length within a range of 1.4-1.6 mm (e.g., 1.48 mm), and the second fixing portion 432 has a minimum width W432 within a range of 0.23-0.27 mm (e.g., 0.25 mm).

Figure 9:
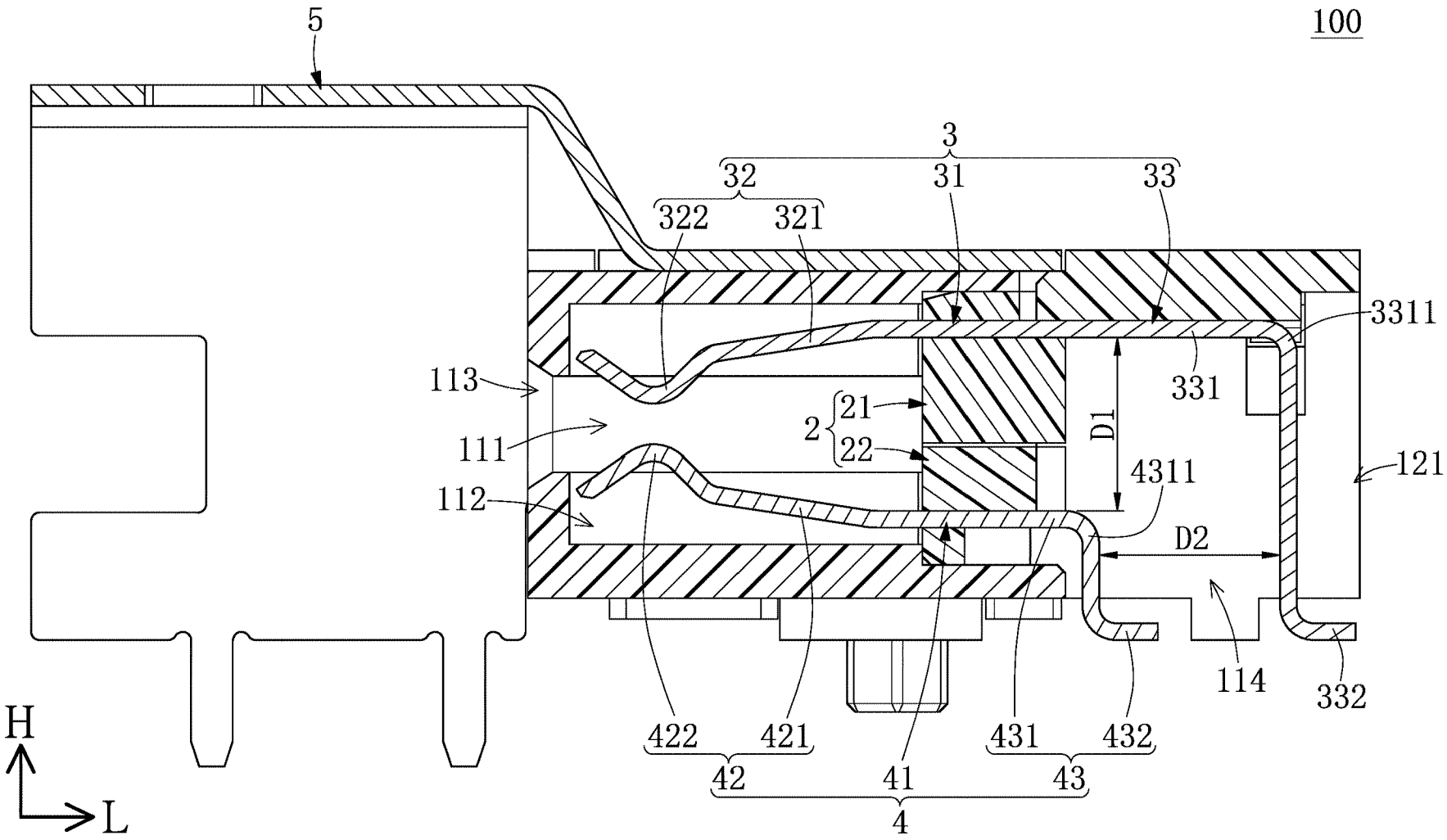
FIG. 9 is a cross-sectional view taken along the cross-sectional line IX-IX of FIG. 1.
Figure 10:
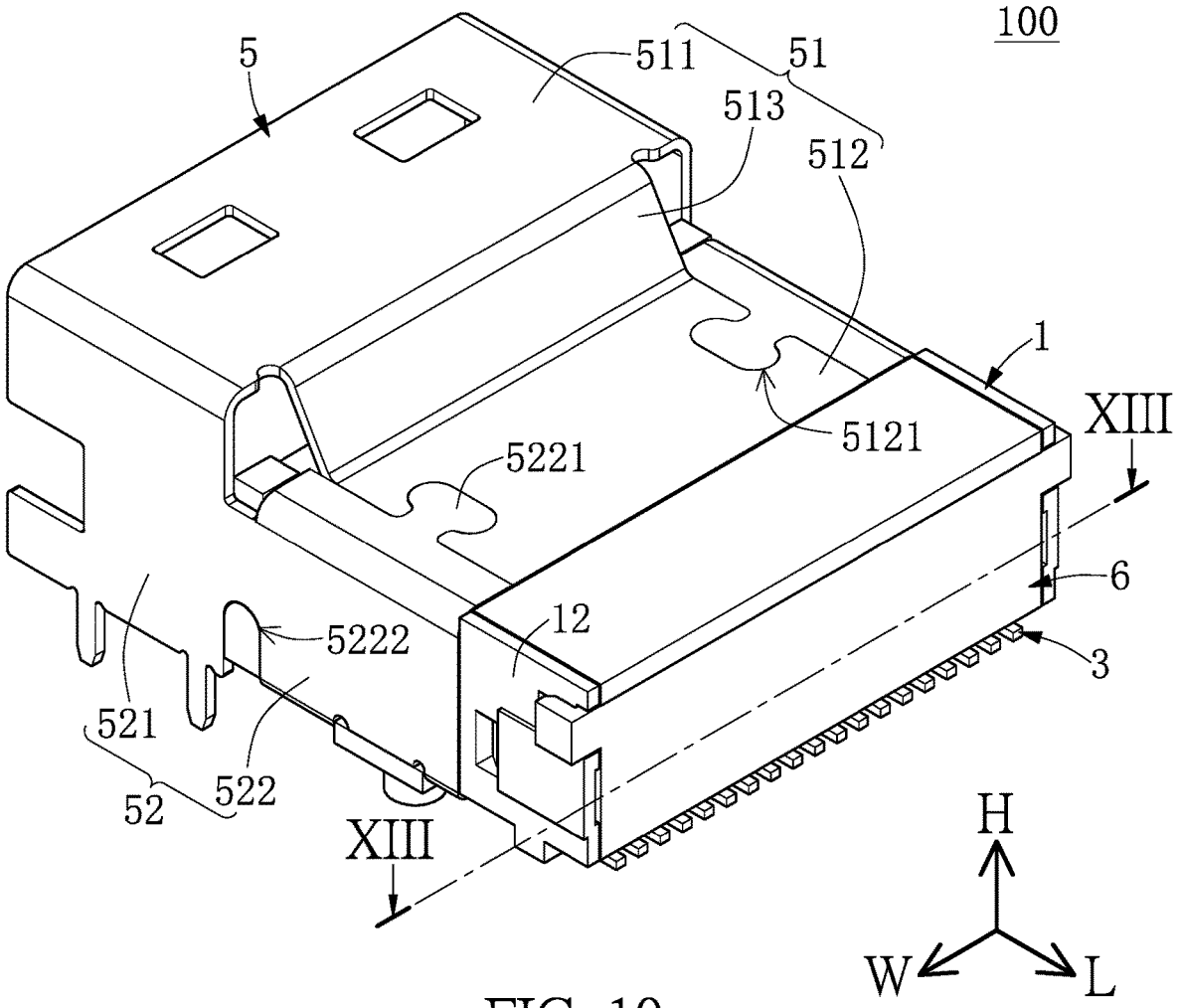
FIG. 10 is a perspective view of a high speed connector according to a second embodiment of the present disclosure.
Figure 11:
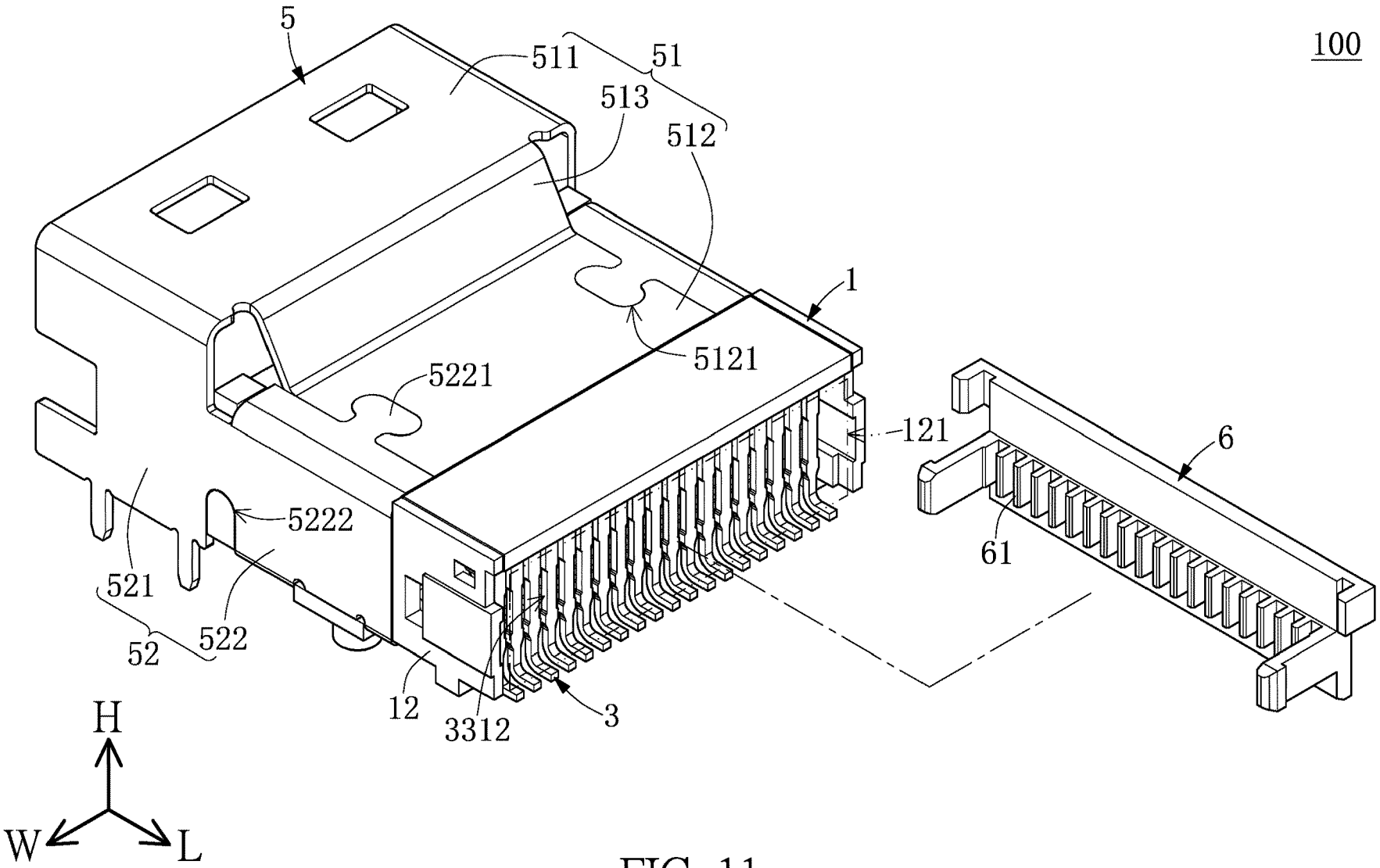
FIG. 11 is an exploded view of FIG. 10.
Figure 12:
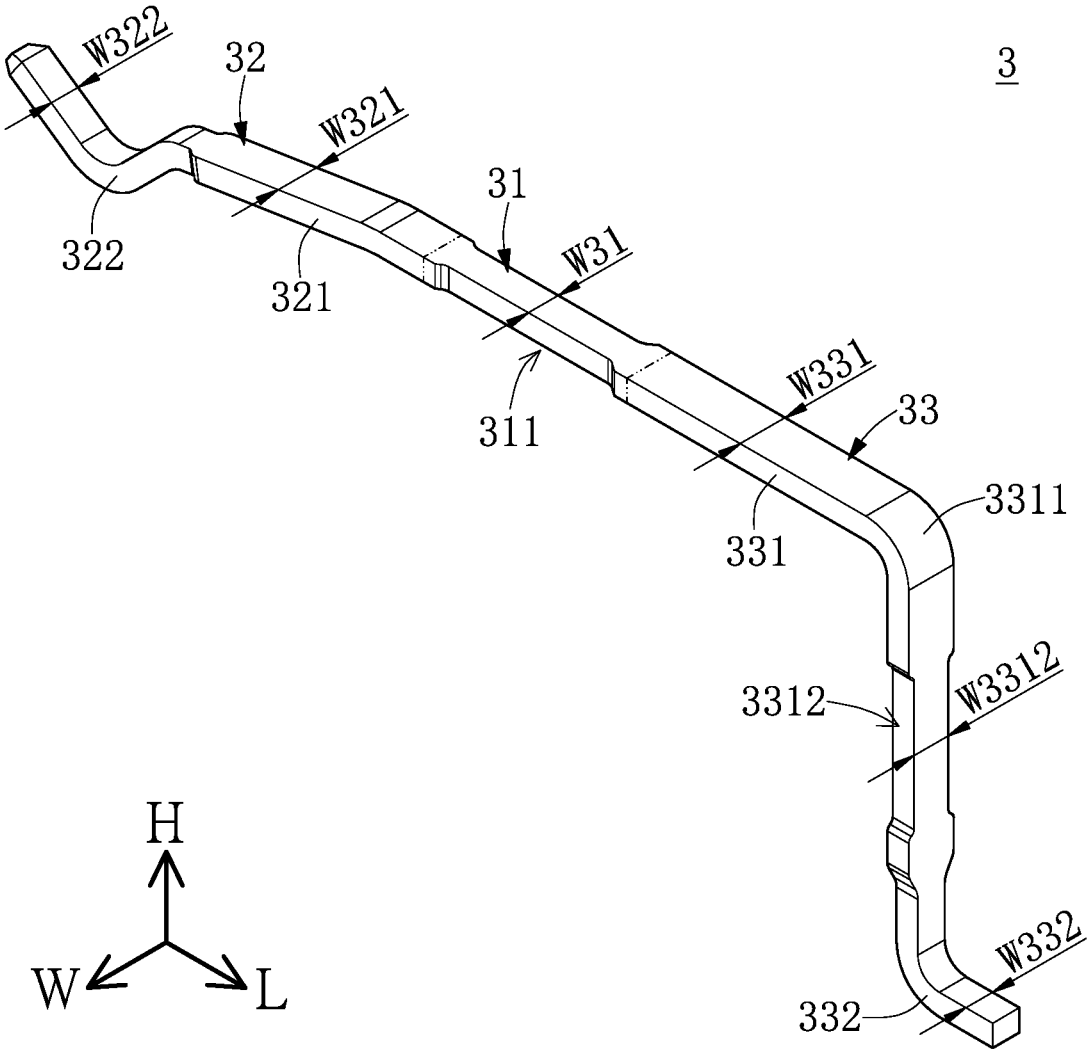
FIG. 12 is a perspective view of a first conductive terminal according to the second embodiment of the present disclosure.
Figure 13:
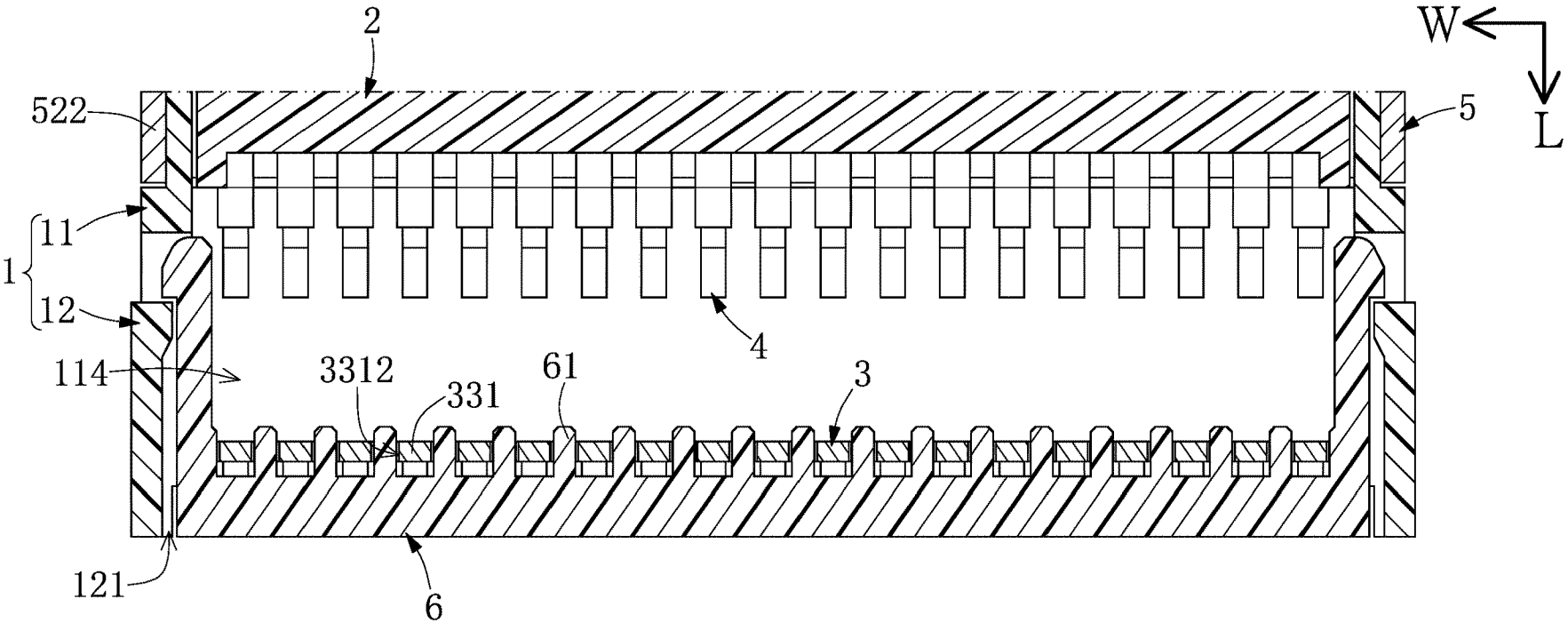
FIG. 13 is a cross-sectional view taken along the cross-sectional line XIII-XIII of FIG. 10.

As shown in FIG. 5, FIG. 6, and FIG. 9, it should be noted that the second conductive terminals 4 respectively correspond in position to the first conductive terminals 3. In the present embodiment, the first embedded segments 31 and the first contacting segments 32 of the first conductive terminals 3 respectively face and are mirror-symmetrical to the second embedded segments 41 and the second contacting segments 42 of the second conductive terminals 4 along the height direction H. Ends of the first fixing portions 332 of the first conductive terminals 3 are coplanar with ends of the second fixing portions 432 of the second conductive terminals 4.

Moreover, in each of the first conductive terminals 3 and the corresponding second conductive terminal 4, the first rear extending portion 331 has a first bending corner 3311 with 90 degrees, the second rear extending portion 431 has a second bending corner 4311 with 90 degrees that is arranged at an inner side of the first bending corner 3311, and a distance D1 between the second bending corner 4311 and the first fixing segment 33 in the height direction H is equal to a distance D2 between the second bending corner 4311 and the first fixing segment 33 in the inserting direction L.

In addition, the insulating core 2, the first conductive terminals 3, and the second conductive terminals 4 in the present embodiment can be jointly defined as a transmission module of the high speed connector 100 for transmitting a high frequency signal having a frequency band within a range of 12-17 GHz by a speed within a range of 20-25 Gbps, but the transmission module is not limited to the present embodiment. For example, in other embodiments of the present disclosure, the transmission module can be applied to other high speed connectors.

Figure 3:
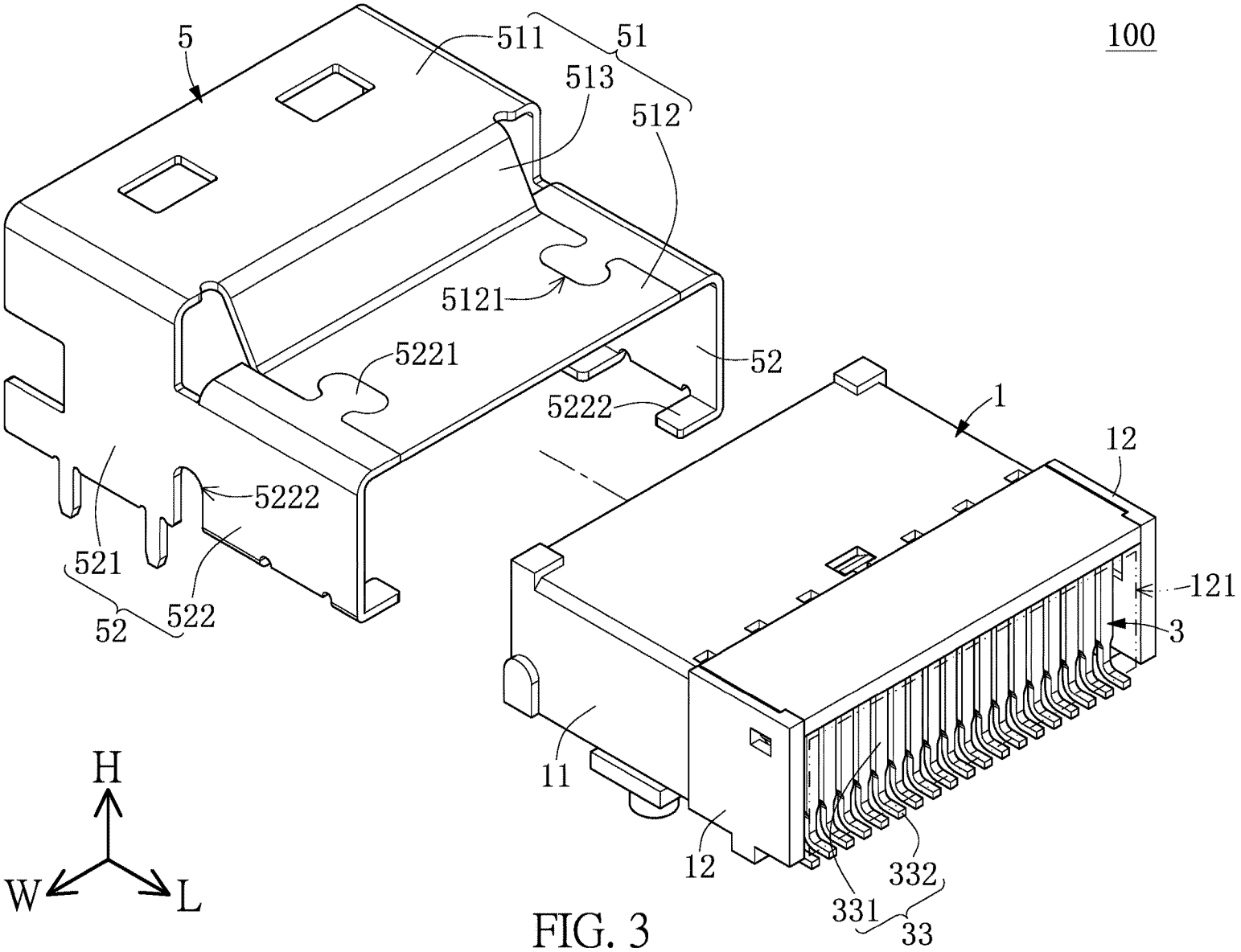
FIG. 3 is an exploded view of FIG. 1.
Figure 4:
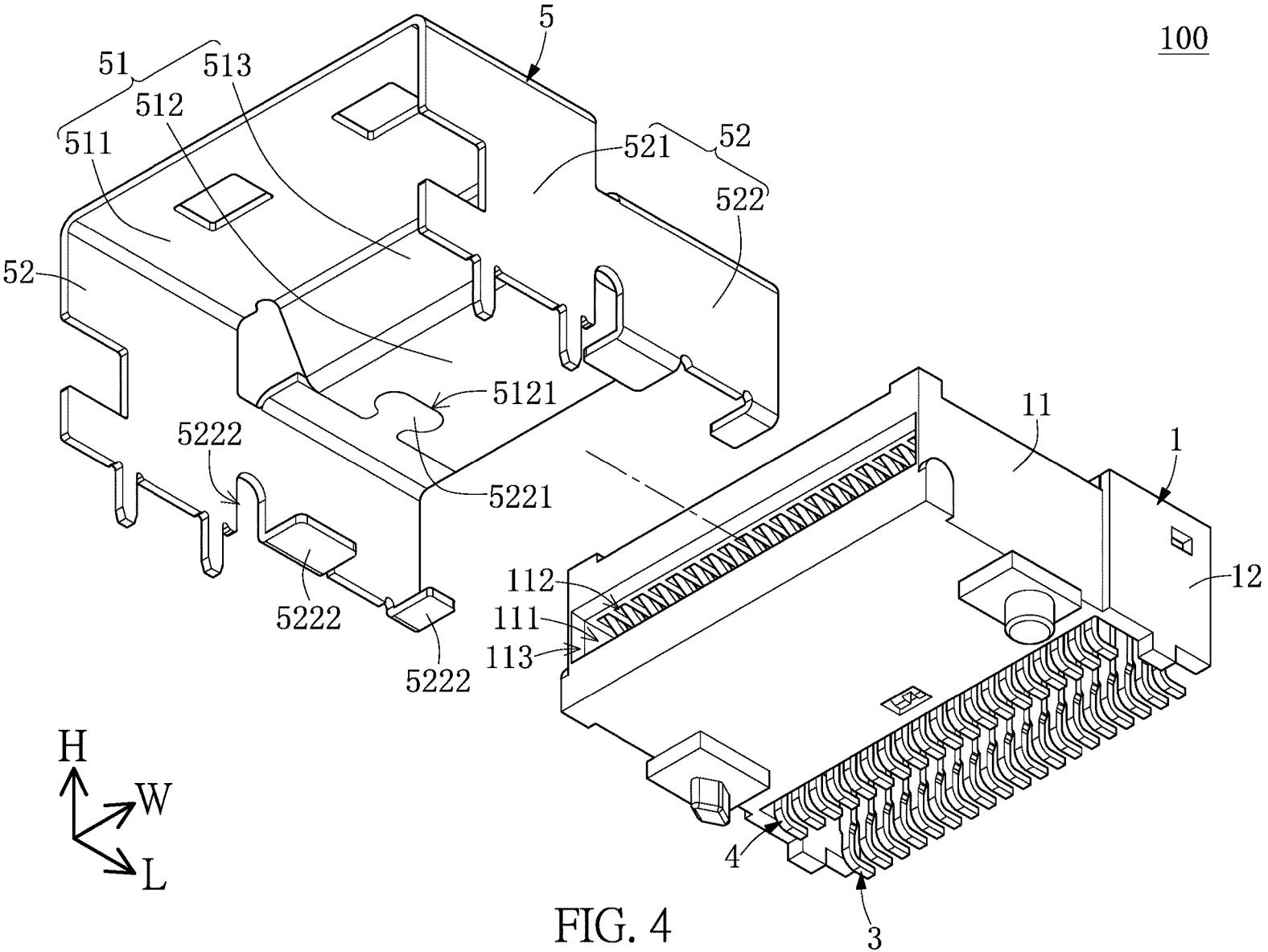
FIG. 4 is an exploded view of FIG. 2.

As shown in FIG. 3, FIG. 4, and FIG. 9, the metallic shell 5 in the present embodiment is a one piece structure formed by bending a metallic plate. The metallic shell 5 includes a top plate 51 and two side plates 52 perpendicularly connected to two opposite edges of the top plate 51.

The top plate 51 has a front top plate 511, a rear top plate 512, and a connecting plate 513 curvedly connected to the front top plate 511 and the rear top plate 512. The front top plate 511 and the rear top plate 512 are located at two different positions in the height direction H. Specifically, the connecting plate 513 in the present embodiment is slantingly connected to the front top plate 511 and the rear top plate 512, so that the front top plate 511 and the rear top plate 512 can be arranged at the two different positions in the height direction H. Moreover, the rear top plate 512 is disposed on the housing 1, and the rear top plate 512 has two linking portions 5121 arranged along the width direction W.

The two side plates 52 in the present embodiment are substantially mirror-symmetrical to the top plate 51. Each of the two side plates 52 has a front side plate 521 and a rear side plate 522 that is coplanar with the front side plate 521. The two front side plates 521 are perpendicularly connected to two opposite edges of the front top plate 511, and the two rear side plates 522 are disposed on the housing 1. Specifically, each of the two rear side plates 522 has a top engaging portion 5221 and at least one rear engaging portion 5222. The top engaging portions 5221 of the two rear side plates 522 are respectively engaged with the two linking portions 5121 of the rear top plate 512, and the at least one rear engaging portion 5222 of each of the two rear side plates 522 is engaged with the housing 1 (e.g., two side surfaces and a bottom surface of the housing 1).

In summary, the metallic shell 5 of the high speed connector 100 can be firmly and quickly engaged with the housing 1 by the structural design of the metallic shell 5, thereby effectively providing an electromagnetic shielding. Moreover, the first embedded segments 31 and the first contacting segments 32 of the first conductive terminals 3 and the second embedded segments 41 and the second contacting segments 42 of the second conductive terminals 4 are arranged in a space surroundingly defined by the metallic shell 5.

Second Embodiment

Referring to FIG. 10 to FIG. 13, a second embodiment of the present disclosure provides a high speed connector 100. The present embodiment is similar to the first embodiment, so that the same features of the two embodiments are selectively disclosed in the following description, and the difference between the two embodiments is disclosed as follows.

In the present embodiment, the high speed connector 100 further includes a rear cover 6 detachably arranged in the hole 121 of the housing 1. The rear cover 6 is inserted into and fixed to the first fixing segments 33 of the first conductive terminals 3. Each of the first rear extending portions 331 has two concavities 3312 respectively recessed in two opposite sides (e.g., two opposite long edges) thereof, and each of the first rear extending portions 331 has a minimum width W3312 between the two concavities 3312 being within a range of 0.3-0.34 mm (e.g., 0.32 mm). The rear cover 6 has a plurality of clipping ribs 61 formed on an inner surface of the rear cover 6, and the rear cover 6 can be inserted into and fixed in the two concavities 3312 of each of the first rear extending portions 331 by the clipping ribs 61. Specifically, in each of the first conductive terminals 3, a portion of the first fixing segment 33 parallel to the height direction H has a center part formed with the two concavities 3312, and a length of each of the two concavities 3312 is within a range of 1.1-1.3 mm (e.g., 1.2 mm), but the present disclosure is not limited thereto.

In conclusion, the high speed connector and the transmission module of the present disclosure can have a better transmission performance of high frequency signal (e.g., an insertion loss and a return loss) by designing the first conductive terminals and the second conductive terminals with certain dimensions and by cooperating the first conductive terminals and the second conductive terminals with the insulating core. Accordingly, the high speed connector and the transmission module of the present disclosure can each be provided without any grounding bar.

The foregoing description of the exemplary embodiments of the disclosure has been presented only for the purposes of illustration and description and is not intended to be exhaustive or to limit the disclosure to the precise forms disclosed. Many modifications and variations are possible in light of the above teaching.

The embodiments were chosen and described in order to explain the principles of the disclosure and their practical application so as to enable others skilled in the art to utilize the disclosure and various embodiments and with various modifications as are suited to the particular use contemplated. Alternative embodiments will become apparent to those skilled in the art to which the present disclosure pertains without departing from its spirit and scope.

What is claimed is:

1. A high speed connector for transmitting a high frequency signal having a frequency band within a range of 12-17 GHz by a speed within a range of 20-25 Gbps, comprising:

a housing having an insertion opening that provides for an insertion of a mating connector along an inserting direction;

an insulating core inserted into the housing;

a plurality of first conductive terminals fixed to the insulating core and arranged along a width direction perpendicular to the inserting direction, wherein each of the first conductive terminals includes:

a first embedded segment fixed and embedded in the insulating core, wherein the first embedded segment has a minimum width that is within a range of 0.26-0.3 mm;

a first contacting segment extending from the first embedded segment toward the insertion opening to sequentially include a first front extending portion and a first contacting portion, wherein the first front extending portion has a maximum width that is within a range of 0.34-0.38 mm, and the first contacting portion has a maximum width that is within a range of 0.23-0.27 mm; and a first fixing segment extending from the first embedded segment along a direction away from the insertion opening to sequentially include a first rear extending portion and a first fixing portion, wherein the first rear extending portion has a maximum width that is within a range of 0.34-0.38 mm;

a plurality of second conductive terminals fixed to the insulating core and arranged along the width direction, wherein the second conductive terminals respectively correspond in position to the first conductive terminals, and each of the second conductive terminals includes:

a second embedded segment fixed and embedded in the insulating core, wherein the second embedded segment has a minimum width that is within a range of 0.26-0.3 mm;

a second contacting segment extending from the second embedded segment toward the insertion opening to sequentially include a second front extending portion and a second contacting portion, wherein the second front extending portion has a maximum width that is within a range of 0.34-0.38 mm, and the second contacting portion has a maximum width that is within a range of 0.23-0.27 mm; and a second fixing segment extending from the second embedded segment along a direction away from the insertion opening to sequentially include a second rear extending portion and a second fixing portion, wherein the second rear extending portion has a maximum width that is within a range of 0.34-0.38 mm; and a metallic shell engaged with an outer surface of the housing, wherein the first embedded segments and the first contacting segments of the first conductive terminals and the second embedded segments and the second contacting segments of the second conductive terminals are arranged in a space surroundingly defined by the metallic shell, wherein the first embedded segments and the first contacting segments of the first conductive terminals respectively face and are mirror-symmetrical to the second embedded segments and the second contacting segments of the second conductive terminals along a height direction that is perpendicular to the inserting direction and the width direction.

2. The high speed connector according to claim 1, wherein in each of the first conductive terminals and the corresponding second conductive terminal, the first rear extending portion has a first bending corner, the second rear extending portion has a second bending corner arranged at an inner side of the first bending corner, an end of the first fixing portion is coplanar with an end of the second fixing portion, and a distance between the second bending corner and the first fixing segment in the height direction is equal to a distance between the second bending corner and the first fixing segment in the inserting direction.

3. The high speed connector according to claim 2, wherein the minimum width of each of the first fixing portions and the minimum width of each of the second fixing portions are each within a range of 0.23-0.27 mm.

4. The high speed connector according to claim 1, wherein the housing has a hole arranged away from the insertion opening, the high speed connector includes a rear cover detachably arranged in the hole, and wherein each of the first rear extending portions has two concavities respectively recessed in two opposite sides thereof, each of the first rear extending portions has a minimum width between the two concavities and being within a range of 0.3-0.34 mm, and the rear cover is inserted into and fixed in the two concavities of each of the first rear extending portions.

5. The high speed connector according to claim 4, wherein in each of the first conductive terminals, a portion of the first fixing segment parallel to the height direction has a center part formed with the two concavities, and a length of each of the two concavities is within a range of 1.1-1.3 mm.

6. The high speed connector according to claim 1, wherein the housing has a hole arranged away from the insertion opening, each of the first fixing segments is exposed from the hole, and each of the first rear extending portions is formed without any concavities.

7. The high speed connector according to claim 1, wherein in each of the first conductive terminals, the first embedded segment has a length within a range of 1.4-1.6 mm, the first extending portion has a length within a range of 2.3-2.5 mm, and the first rear extending portion has a length within a range of 5.7-5.9 mm, and wherein in each of the second conductive terminals, the second embedded segment has a length within a range of 1.4-1.6 mm, the second extending portion has a length within a range of 2.3-2.5 mm, and the second rear extending portion has a length within a range of 1.4-1.6 mm.

8. The high speed connector according to claim 1, wherein the metallic shell includes:

a top plate having a front top plate, a rear top plate, and a connecting plate curvedly connected to the front top plate and the rear top plate, wherein the front top plate and the rear top plate are located at two different positions in the height direction, the rear top plate is disposed on the housing, and the rear top plate has two linking portions arranged along the width direction; and two side plates each having a front side plate and a rear side plate that is coplanar with the front side plate, wherein the two front side plates are perpendicularly connected to two opposite edges of the front top plate, the two rear side plates are disposed on the housing, and wherein each of the two rear side plates has a top engaging portion and at least one rear engaging portion, the top engaging portions of the two rear side plates are respectively engaged with the two linking portions of the rear top plate, and the at least one rear engaging portion of each of the two rear side plates is engaged with the housing.

9. A transmission module of a high speed connector for transmitting a high frequency signal having a frequency band within a range of 12-17 GHz by a speed within a range of 20-25 Gbps, comprising:

an insulating core;

a plurality of first conductive terminals fixed to the insulating core and arranged along a width direction, wherein each of the first conductive terminals includes:

a first embedded segment fixed and embedded in the insulating core, wherein the first embedded segment has a minimum width that is within a range of 0.26-0.3 mm;

a first contacting segment extending from one end of the first embedded segment and sequentially including a first front extending portion and a first contacting portion, wherein the first front extending portion has a maximum width that is within a range of 0.34-0.38 mm, and the first contacting portion has a maximum width that is within a range of 0.23-0.27 mm; and a first fixing segment extending from another end of the first embedded segment and sequentially including a first rear extending portion and a first fixing portion, wherein the first rear extending portion has a maximum width that is within a range of 0.34-0.38 mm; and a plurality of second conductive terminals fixed to the insulating core and arranged along the width direction, wherein the second conductive terminals respectively correspond in position to the first conductive terminals, and each of the second conductive terminals includes:

a second embedded segment fixed and embedded in the insulating core, wherein the second embedded segment has a minimum width that is within a range of 0.26-0.3 mm;

a second contacting segment extending from one end of the second embedded segment and sequentially including a second front extending portion and a second contacting portion, wherein the second front extending portion has a maximum width that is within a range of 0.34-0.38 mm, and the second contacting portion has a maximum width that is within a range of 0.23-0.27 mm; and a second fixing segment extending from another end of the second embedded segment and sequentially including a second rear extending portion and a second fixing portion, wherein the second rear extending portion has a maximum width that is within a range of 0.34-0.38 mm, wherein the first embedded segments and the first contacting segments of the first conductive terminals respectively face and are mirror-symmetrical to the second embedded segments and the second contacting segments of the second conductive terminals along a height direction that is perpendicular to the width direction.

10. The transmission module of the high speed connector according to claim 9, wherein in each of the first conductive terminals and the corresponding second conductive terminal, the first rear extending portion has a first bending corner, the second rear extending portion has a second bending corner arranged at an inner side of the first bending corner, an end of the first fixing portion is coplanar with an end of the second fixing portion, and a distance between the second bending corner and the first fixing segment in the height direction is equal to a distance between the second bending corner and the first fixing segment in the inserting direction.

* * * * *